US008572875B2

(12) United States Patent
Sisgold

(10) Patent No.: US 8,572,875 B2
(45) Date of Patent: Nov. 5, 2013

(54) BOLT-HOLD OPEN APPARATUS

(76) Inventor: Chase B. Sisgold, Palm Harbor, FL (US)

( * ) Notice: Subject to any disclaimer, the term of this patent is extended or adjusted under 35 U.S.C. 154(b) by 276 days.

(21) Appl. No.: 13/184,060

(22) Filed: Jul. 15, 2011

(65) Prior Publication Data

US 2013/0014416 A1 Jan. 17, 2013

(51) Int. Cl.
*F41A 9/62* (2006.01)
*F41A 3/12* (2006.01)

(52) U.S. Cl.
USPC ..... 42/1.02; 42/49.02; 89/138

(58) Field of Classification Search
USPC ..... 42/1.02, 49.01, 50, 49.02, 1.05, 70.02, 42/18; 89/138, 137, 153, 180, 181, 89/187.01, 189
See application file for complete search history.

(56) References Cited

U.S. PATENT DOCUMENTS

| | | | | | |
|---|---|---|---|---|---|
| 2,321,045 | A * | 6/1943 | Roemer | 89/138 |
| 2,363,772 | A * | 11/1944 | Browning | 89/138 |
| 2,422,853 | A * | 6/1947 | Reising | 42/16 |
| 3,098,311 | A * | 7/1963 | Savioli | 42/18 |
| 3,177,601 | A * | 4/1965 | Meunier | 42/18 |
| 3,540,142 | A * | 11/1970 | Billett et al. | 42/22 |
| 3,593,452 | A * | 7/1971 | Pekarek | 42/16 |
| 4,128,042 | A * | 12/1978 | Atchisson | 89/138 |
| 4,455,919 | A * | 6/1984 | Osborne et al. | 89/138 |
| 5,588,241 | A * | 12/1996 | Hurley | 42/50 |
| 5,608,981 | A * | 3/1997 | Canaday | 42/25 |
| 6,510,778 | B1 * | 1/2003 | Irwin | 89/138 |
| 6,851,346 | B1 * | 2/2005 | Herring | 89/1.4 |
| 7,219,462 | B2 * | 5/2007 | Finn | 42/49.01 |
| 7,261,029 | B1 * | 8/2007 | Davis | 89/148 |
| 7,395,747 | B2 * | 7/2008 | Murello | 89/137 |
| 7,596,900 | B2 * | 10/2009 | Robinson et al. | 42/7 |
| 7,661,219 | B1 * | 2/2010 | Knight et al. | 42/70.02 |
| 8,261,652 | B2 * | 9/2012 | Findlay | 89/181 |
| 8,359,966 | B1 * | 1/2013 | Brotherton | 89/181 |
| 8,387,296 | B2 * | 3/2013 | Overstreet et al. | 42/50 |
| 2003/0208940 | A1 * | 11/2003 | Johnson | 42/18 |
| 2003/0208941 | A1 * | 11/2003 | Johnson | 42/18 |
| 2005/0000138 | A1 * | 1/2005 | Kiss | 42/50 |
| 2005/0011345 | A1 * | 1/2005 | Herring | 89/1.4 |
| 2005/0183310 | A1 * | 8/2005 | Finn | 42/49.01 |
| 2011/0056107 | A1 * | 3/2011 | Underwood | 42/18 |
| 2011/0247483 | A1 * | 10/2011 | Overstreet et al. | 89/138 |
| 2012/0167424 | A1 * | 7/2012 | Gomez | 42/14 |

* cited by examiner

*Primary Examiner* — Michael Carone
*Assistant Examiner* — Reginald Tillman, Jr.
(74) *Attorney, Agent, or Firm* — Frank Liebenow; Justin Miller; Larson & Larson P.A.

(57) ABSTRACT

A firearm-magazine interface for replacing an existing firearm-magazine interface of many existing firearms such as assault rifles, namely AK series (AK74, AK47, etc.) provides a lock that holds open the bolt after a last round is fired from a magazine. The firearm-magazine interface also includes a single-button magazine eject. After firing the last round, a bolt-hold lock is urged upwardly in the path of the returning bolt and catches a face of the bolt, thereby locking the bolt open until the magazine is replaced with a replacement magazine, at which time a bolt-hold release paddle pulls the bolt-hold lock downwardly, releasing the bolt to chamber a first round from the replacement magazine.

20 Claims, 3 Drawing Sheets

BOLT-HOLD OPEN APPARATUS

FIELD

This invention relates to firearms and, more particularly, to an adapter for a particular type of firearm that utilizes a different magazine, enhancing the operation of that particular firearm with a bolt-hold-open feature.

BACKGROUND

As disclosed in U.S. Pat. No. 7,261,029 to Davis, the Kalashnikov assault rifle, for example the AK-47, and its variants comprise one of the largest groups of firearms on earth. It has been estimated that over 90 million of these firearms have been produced in dozens of countries since their introduction in the Soviet Union in 1946. Developed primarily as a military weapon, the AK-47 became famous for its simplicity of operation and reliability in extreme conditions of use. Because of its mild recoil, the AK-47 has the capability of delivering effective fully-automatic fire at a range of 300 meters. U.S. Pat. No. 7,261,029 to Davis is hereby incorporated by reference.

The AK-74 and variants have issues that make it less than optimal for use as a weapon. These rifles (e.g. the AK-74) lack a means to hold the bolt open after the last round is fired from its magazine. When the last round in a magazine is fired, the shooter does not know that the chamber is empty until the shooter attempts to fire. After the last round in the magazine is fired and ejected, the bolt carrier and bolt loudly slide to breech. Chambering another round requires that a loaded magazine be inserted into the receiver and the bolt carrier be pulled back (cocked). This causes the shooter to lower the rifle from a firing position at the shoulder in order to gain sufficient leverage, making the shooter vulnerable to an aggressor.

It is known to construct detachable firearm magazines such that they will indicate to the shooter when the last cartridge in the magazine has been discharged. The magazines alert the user to the fact that they are empty but do not prevent the forward movement of the bolt carrier and bolt when the magazine is detached from the rifle. Thus, reloading a rifle outfitted with such magazines still requires that the shooter drop the firearm from a firing position to pull the bolt carrier to chamber the first round.

What is needed is an apparatus that will interface with commonly available magazines that are designed to interface with a bolt-hold-open mechanism of existing firearms with firearms that are not provided with a bolt-hold-open mechanism, thereby providing a bolt-hold-open feature after the last round from the magazine is fired.

SUMMARY

In general, the disclosed firearm-magazine interface replaces the existing firearm-magazine interface of many existing firearms such as assault rifles, namely AK series (AK74, AK47, etc.). The disclosed firearm-magazine interface accepts AR-15 magazines (magazines made for use with an AR-15 variant of firearm) for use with the AK series of firearms (e.g AK74, AK47, etc.). The firearm-magazine interface also provides a mechanism that holds open the bolt after a last round is fired from a magazine and a single-button magazine eject such that, after firing the last round, one button is pressed to eject the empty magazine, a fresh magazine is locked into place and a second lever/button is pressed to release the bolt and chamber a first round from the fresh magazine without having to re-cock the bolt.

In one embodiment, a firearm-magazine interface is disclosed. The firearm has a spring-loaded bolt and a receiver cross-member pin that is located in the vicinity of a magazine opening. The firearm-magazine interface includes a magazine frame for receiving a magazine, the magazine frame is mounted to the firearm at the magazine opening by, for example, rivets. The magazine contains zero or more rounds of ammunition and the rounds of ammunition are spring-biased toward the firearm when the magazine is installed in the magazine frame. The firearm-magazine interface includes a bolt-hold lock that is slideably interfaced to the magazine frame. A follower contact ledge of the bolt-hold lock interfaces with the magazine follower of the magazine. The magazine follower pushes against the follower contact ledge after the last round has been dispensed from the magazine. The bolt-hold lock has a retracted position whereas the spring-loaded bolt freely passes over the bolt-hold lock and the bolt-hold lock has an extended position, whereas when the magazine is empty, the magazine follower lifts the bold-hold lock to the extended position, thereby a rear side surface (bolt catch edge) of the bold-hold lock engages with the spring-loaded bolt, holding the spring-loaded bolt in an open position after a last round is fired from the magazine. A bolt-hold release lever is moveably interfaced to the magazine frame. Activation of the bolt-hold release lever by a bolt-hold release paddle urges the bolt-hold lock away from the extended position to the retracted position and away from the spring-loaded bolt, thereby releasing the spring-loaded bolt to chamber a round from a new magazine. The bolt-hold lock is braced against the receiver cross-member pin, providing support to counter a force exerted by the returning spring-loaded bolt.

In another embodiment, a firearm-magazine interface is disclosed. The firearm has a bolt and a receiver cross-member pin that is located in the vicinity of the magazine opening. The firearm-magazine interface includes a magazine frame for receiving a magazine and the magazine frame is mounted to the firearm at the magazine opening by, for example, rivets. The magazine contains zero or more rounds of ammunition and the rounds of ammunition are spring-biased toward the firearm when the magazine is inserted into the magazine frame. The firearm-magazine interface includes a bolt-hold lock slideably interfaced to and held by the magazine frame. The bolt-hold lock is braced against the receiver cross-member pin, providing support to counter a force exerted by the returning spring loaded bolt. A first area of the bolt-hold lock has an angled forward edge that is positioned closest to the chamber of the firearm and a substantially flat bolt-catch edge that is substantially perpendicular to a path of travel of the bolt positioned on a side distal from the chamber. The first area of the bolt-hold lock also has a follower contact ledge. A distal second area of the bolt-hold lock has a bolt-hold lock pin. The follower contact ledge interfaces with the magazine follower and the bolt-hold lock pin interfaces with a bolt release lever that is spring loaded. The spring biases the bolt release lever and, therefore, the bolt-hold lock away from the bolt. A bolt-hold release paddle is moveably interfaced to the magazine frame and interfaced to the bolt release lever such that after a last round of the magazine is chambered, the magazine follower urges the bolt-hold lock into the path of the bolt and after firing of the last round, an angled surface of the bolt momentarily displaces the bolt-hold lock below the path of the bolt. After the bolt passes the bolt-hold lock, the bolt-hold lock returns upward into the path of the returning spring-loaded bolt such that, the bolt is held open by the bolt catch edge. Later, pressing of the bolt-hold release paddle after the bolt is blocked by the bolt catch edge turns the bolt release lever and pulls down on the bolt-hold lock pin, thereby urging the bolt-hold lock away from the bolt, thereby releasing the bolt towards the chamber.

In another embodiment, a firearm-magazine interface is disclosed. The firearm has a spring-loaded bolt and a receiver cross-member pin that is located in the magazine opening of the firearm. The firearm-magazine interface includes a magazine frame for receiving a magazine. The magazine frame is mounted to the firearm at the magazine opening by, for example, rivets. The magazine contains zero or more rounds of ammunition and the rounds of ammunition are spring-biased by a magazine follower toward the firearm when the magazine is inserted into the magazine frame. The firearm-magazine interface has a bolt-hold lock that is slideably interfaced to and held by the magazine frame. The bolt-hold lock is braced against the receiver cross-member pin, providing support to counter a force exerted by the returning spring-loaded bolt. A first area of the bolt-hold lock has an angled forward edge on a side closest to the chamber of the firearm and a substantially flat bolt-catch edge on a side that is distal from the chamber. The bolt-catch edge is substantially perpendicular to a path of travel of the bolt. The first area of the bolt-hold lock also has a follower contact ledge. The follower contact ledge interfaces with the magazine follower of the magazine. A distal second area of the bolt-hold lock has a bolt-hold lock pin. A bolt release lever is pivotally interfaced to the magazine frame. A first end of the bolt release lever interfaces to the bolt-hold lock pin and a second, distal end of the bolt release lever interfaces to a bolt-hold release paddle. A bolt-hold lock return spring is interfaced between the magazine frame and the bolt release lever, urging the bolt release lever in a direction that biases the bolt-hold lock away from the bolt. A magazine release button is urged outwardly from the magazine frame by a magazine catch spring. The magazine release button is slideably interfaced to a second opposing side of the magazine frame with respect to the bolt-hold release paddle and is mechanically connected to a magazine catch.

After a last round of the magazine is chambered, the magazine follower urges the bolt-hold lock into the path of the bolt. After firing of the last round, as the bolt returns, an angled surface of the bolt momentarily displaces the bolt-hold lock below the path of travel of the bolt and after the bolt passes the bolt-hold lock, the bolt-hold lock returns upward into the path of travel of the bolt, such that, the returning spring-loaded bolt pushes against the substantially flat bolt-catch edge of the bolt-hold lock, thereby holding the bolt open. Afterwards, pressing the bolt-hold release paddle urges the bolt-hold lock away from the bolt, thereby releasing the bolt towards the chamber. Pressing of the magazine release button moves the magazine catch outwardly away from the magazine, thereby releasing the magazine from the magazine frame.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
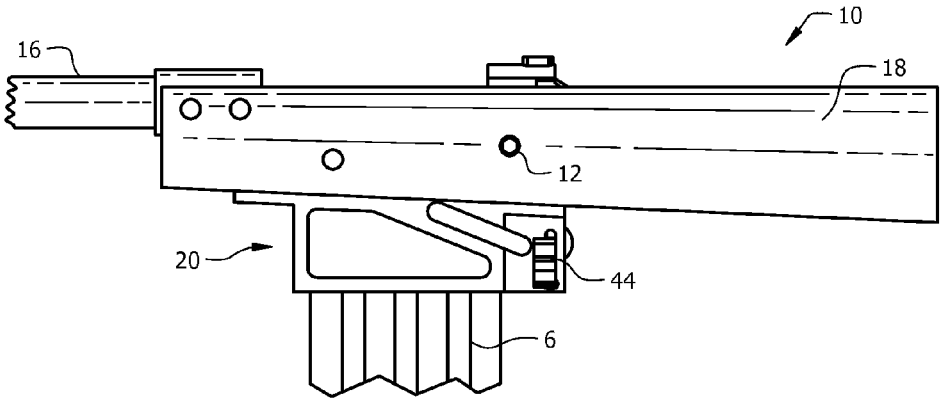
FIG. 1 illustrates a partial side plan view of a firearm with an improved firearm-magazine interface.

Reference will now be made in detail to the presently preferred embodiments of the invention, examples of which are illustrated in the accompanying drawings. Throughout the following detailed description, the same reference numerals refer to the same elements in all figures.

Referring now to the FIG. 1, a typical firearm 10 with the firearm magazine interface 20 is shown. The firearm is, for example, an AK47 or preferably an AK74, also known as the Kalashnikov assault rifle. Since the firearm 10 is well known to those of ordinary skill in the art, only sufficient detail will be provided for a full understanding of the manner in which the firearm magazine-interface 20 operates and interfaces with the firearm 10.

Figure 2:
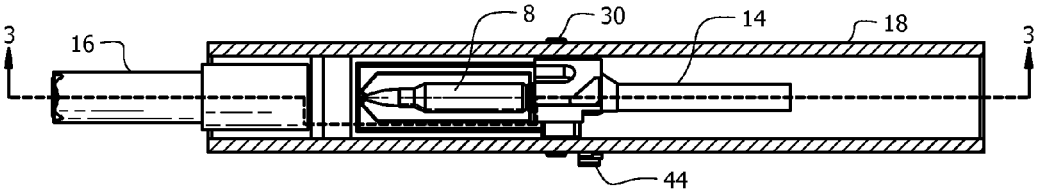
FIG. 2 illustrates a partial top plan view of a firearm with the improved firearm-magazine interface.

In FIGS. 1 and 2, the firearm 10 is shown with a magazine 6. The stock firearm magazine-interface (not shown) has been removed and the firearm magazine-interface 20 of improved construction is installed.

A portion of the firearm 10 is shown in a simplified fashion, as the mechanisms and operations of such a firearm 10 are well known and discussed in the prior art. The firearm 10 has a receiver 18 which includes bolt carrier rails (not visible) for receiving the bolt carrier (not visible) which carries the bolt 14 (see FIG. 2). The trigger and trigger mechanism is not shown for brevity purposes, as it is well known in the industry.

Attached to the receiver 18 is the barrel 16. A receiver cross-member pin 12 is used by the firearm magazine-interface 20 to provide a sturdy anchor during the bolt-hold-open action as will be shown later. The firearm magazine-interface 20 is shown with the removably attached magazine 6 inserted. The firearm magazine-interface 20 replaces the stock magazine-interface (not shown) and the firearm magazine-interface 20 is attached to the firearm 10 using the same or similar mounting arrangement as used for the stock magazine-interface. The bolt-hold-open release paddle 44 will be explained later.

Figure 3A:
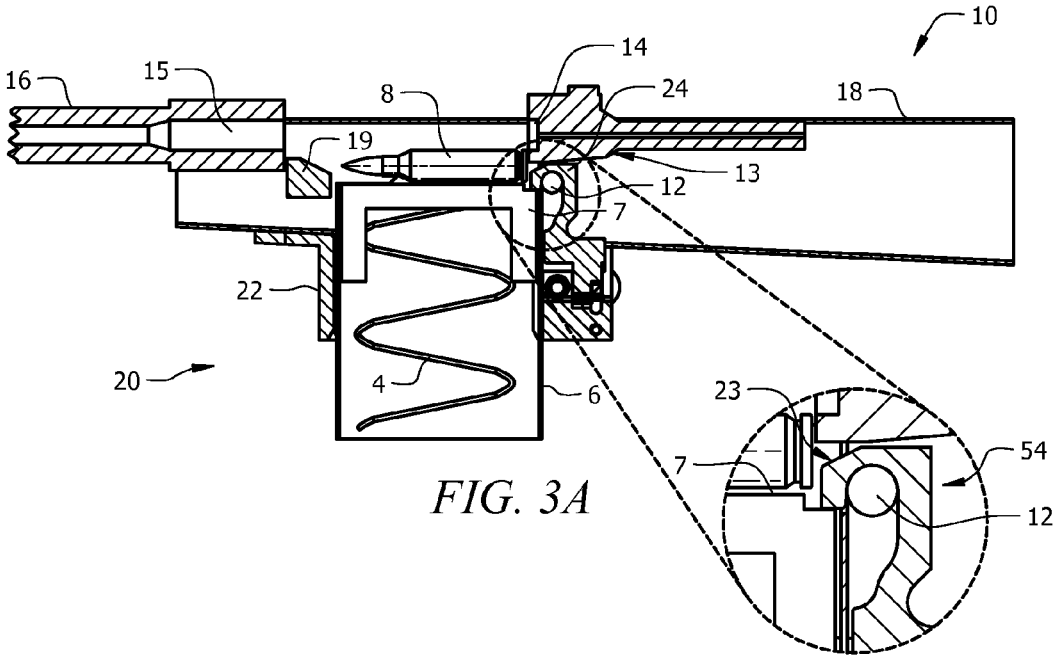
FIG. 3A illustrates a cut-away view of a firearm with the improved firearm-magazine interface along lines 3-3 of FIG. 2 showing a magazine having one remaining round.
Figure 3B:
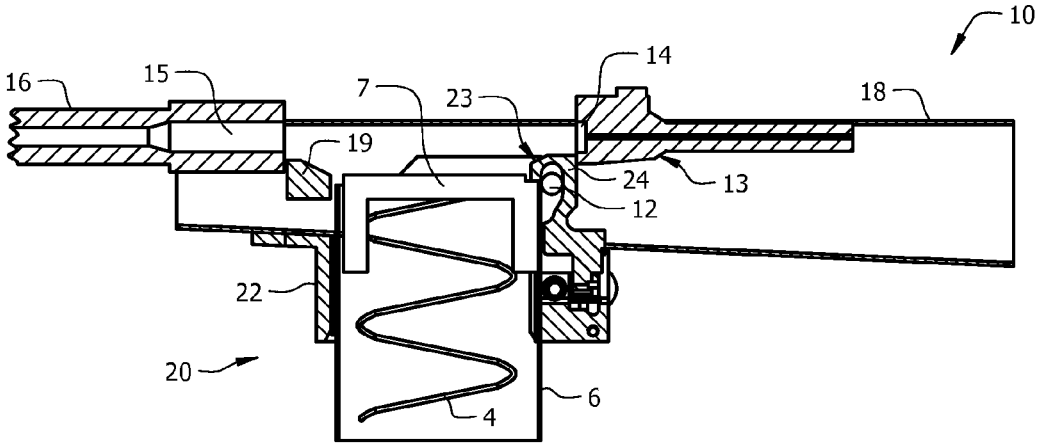
FIG. 3B illustrates a cut-away view of a firearm with the improved firearm-magazine interface along lines 3-3 of FIG. 2 showing an empty magazine.

In FIG. 2, the bolt 14 (e.g. spring-loaded bolt 14) is shown in rearward position, prior to engaging the round 8 into the chamber (see FIG. 3). In a typical operation of the firearm 10, after a first round 8 is fired, back gases force the spring-loaded bolt carrier (not shown) and bolt 14 back far enough to eject the spent cartridge and allow the next round 8 to lift from the spring-loaded magazine 6. Once the gas pressure subsides, the spring-loaded bolt 14 is pushed forward by spring pressure and chambers the next round 8, ready to fire. One problem being solved by the improved firearm magazine-interface 20 is magazine 6 selection. In general, magazines 6 made for one type of firearm 10 (e.g. AK47, AK 74) do not have a mechanism for indicating the last round from the magazine 6 has been fired (e.g. the magazine is empty). Fortunately, other magazines 6 such as those used with, for example, the AR15 or M16 types of firearms have a magazine follower 7 (see FIGS. 3A and 3B) designed to interface with a bolt-hold open mechanism of, for example, the AR15 or M16. The magazine follower 7 provides an upward force and feeds the rounds 8 into the magazine opening and eventually into the chamber 15 (see FIGS. 3A and 3B). After the last round 8 is chambered from the magazine 6 and the magazine 6 is empty, the follower of such magazines 6 pushes upward by force of the magazine spring 4 (see FIGS. 3A and 3B). In such, the magazine follower 7 (see FIGS. 3A/B) mechanically moves upward as the last round 8 is chambered. Therefore, one feature of the firearm magazine-interface 20 is to adapt such magazines 6 originally intended for a different style firearm to the firearm 10. A second feature of the firearm magazine-interface 20 is a bolt-hold-open feature. In this, the firearm magazine-interface 20 uses the magazine follower 7 to lock the spring-loaded bolt 14 in the open position after the last round 8 from the magazine 6 is fired. Another feature of the firearm magazine-interface 20 is a quick-release for the magazine 6, such that, after firing the last round 8 in the magazine 6, a simple press of magazine release button 30 (see FIG. 2) ejects the empty magazine 6 and the shooter need only insert in a new magazine 6 then press the bolt-hold release paddle 44. Pressing of the bolt-hold release paddle 44 initiates return of the bolt 14 and the next round 8 from the new magazine 6 is caught by the bolt 14 and chambered, ready to fire.

Referring to FIGS. 3A and 3B, side cut-away views along line 3-3 of FIG. 2 are shown. The first view in FIG. 3A shows a remaining round 8 in the magazine 6 after firing of the firearm 10. The rounds 8 are pushed upwardly within the magazine 6 by a magazine spring 4, as known in the industry. As the spring-loaded bolt 14 moves forward (returns) by spring pressure, it catches an edge of the next round 8, pushes the round 8 forward, and the round 8 slides up a ramp 19 and into the chamber 15, ready to fire. As the last round 8 is chambered, the magazine follower 7 of the magazine 6 rises and pushes the bolt-hold lock 24 up as shown in FIG. 3B. The magazine spring 4 maintains upward pressure on the magazine follower 7, and, consequently, on the bolt-hold lock 24. As the spring-loaded bolt 14 is pushed back by gas pressure after the last round 8 is fired, an angled surface 13 on the spring-loaded bolt 14 moves against an angled forward edge 23 (see FIG. 4) on the bolt-hold lock 24, temporarily pushing the bolt-hold lock 24 out of the way of the returning spring-loaded bolt 14 until the spring-loaded bolt 14 completely passes the bolt-hold lock 24, at which time the bolt-hold lock 24 is pushed upward by force of the magazine spring 4 pushing upwardly on the magazine follower 7 and upward on the follower catch ledge 50 of the bolt-hold lock 24 (see FIG. 4). The interaction between the spring-loaded bolt 14 and the bolt-hold lock 24 also provides an audible, visual and tactile variation from that provided when rounds 8 are still available in the magazine 6, thereby providing clear indication to the shooter that they have fired the last round 8 in the magazine 6. Note that it is preferred that the angled forward edge 23 be an angle similar to that of the leading angled surface 13 of the bolt 14, though, it is anticipated that other surface shapes 23 will work as well, including curved or rounded surfaces 23.

Once the gas pressure subsides, the spring-loaded bolt 14 is urged towards the chamber 15 by spring force to chamber the next round 8. The spring-loaded bolt 14 has a high amount of force as it is pushed forward under spring pressure. To withstand this force, the bolt-hold lock 24 is supported by the receiver cross-member pin 12, providing sufficient, rigid structure when the face of the spring-loaded bolt 14 hits the bolt-hold lock 24. The face of the spring-loaded bolt 14 pushes against the bolt catch edge 54 of the bolt-hold lock 24, holding the bolt-hold lock up, even after the magazine 6 is removed. Since the bolt-hold lock 24 blocks the movement of the spring-loaded bolt 14, the spring-loaded bolt 14 remains cocked until a new magazine 6 is inserted, at which time the bolt-hold release paddle 44 is pressed, pulling down the bolt-hold lock 24 and allowing the spring-loaded bolt 14 to move forward, catching the top edge of a first round 8 of the new magazine 6 and pushing the round 8 into the chamber 15. Note, prior to the firearm magazine-interface 20, after firing of the last round 8, the spring-loaded bolt 14 would travel forward to the empty chamber 15, without any indication the firearm is empty until the subsequent failure to fire at the next trigger pull. Also, after installing a new magazine 6, the shooter needed to manually pull back the spring-loaded carrier and bolt 14 to chamber the next round 8. Although many a shooter is very quick at this action, the critical seconds when the firearm 10 is not loaded often means life or death. Furthermore, the location of the bolt-hold release paddle 44 is such that as the shooter inserts a new magazine 6, the shooter's thumb is local to the bolt-hold release paddle 44 and pressing of the bolt-hold release paddle 44 is a natural, quick action, taking little extra time above that of inserting the new magazine 6.

Figure 4:
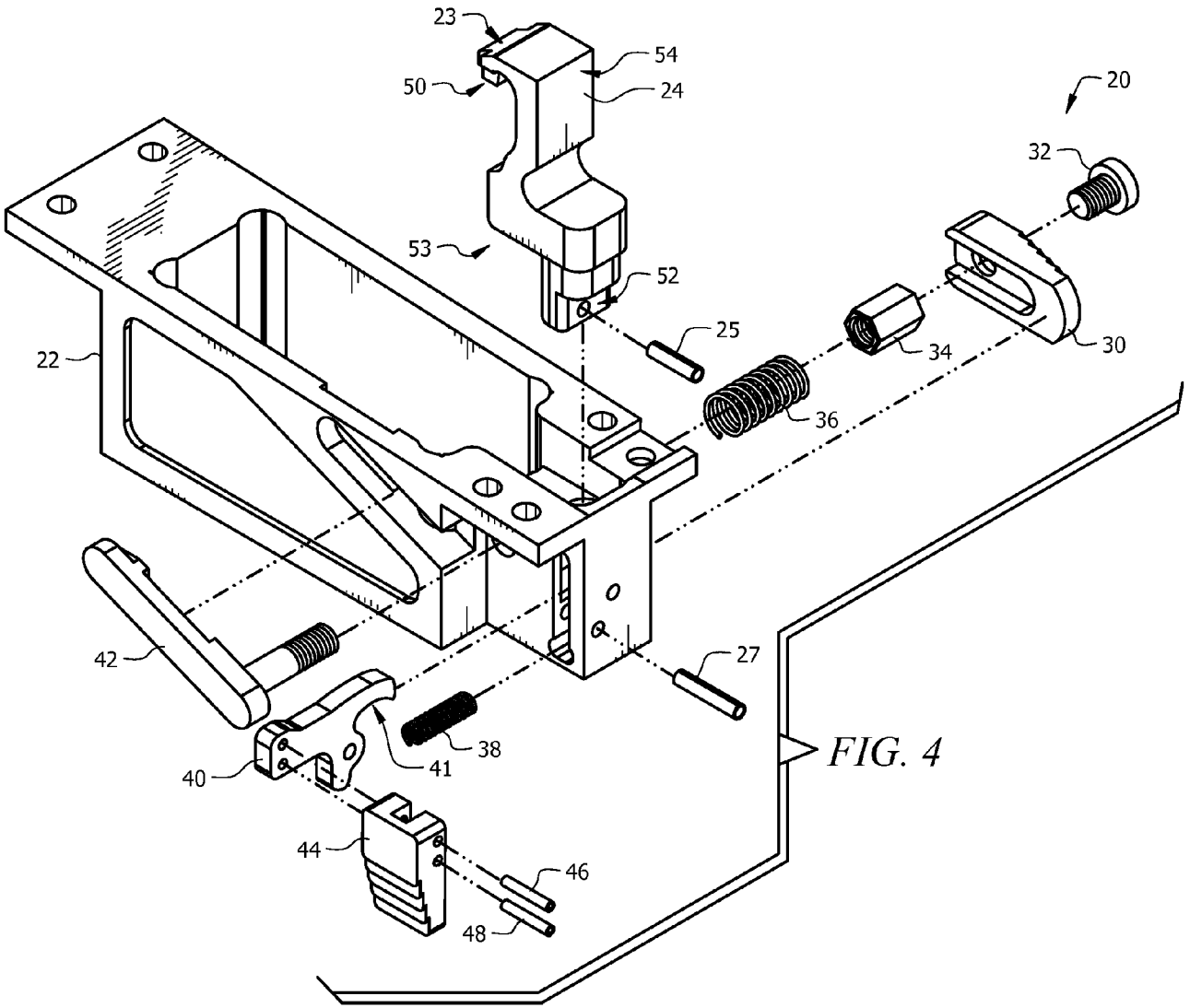
FIG. 4 illustrates an exploded view of the improved firearm-magazine interface.

As shown in the exploded view of the firearm magazine-interface 20 in FIG. 4, the firearm magazine-interface 20 includes a magazine frame 22. A first area 23/50/54 of the bolt-hold lock has an angled forward edge 23, a follower contact ledge 50, and a bolt catch edge 54. The follower contact ledge 50 interfaces with the magazine follower 7 and, therefore, is lifted when the magazine follower 7 lifts under spring force of the magazine spring 4 when the magazine 6 is empty. Note that the follower contact ledge 50 is shown in the first area 23/50/54 of the bolt-hold lock 24 but in alternate embodiments is located in different areas of the bolt-hold lock 24 such as in the distal area 53 of the bolt-hold lock 24.

Pressure and friction of the face of the spring-loaded bolt 14 pushing against the back surface 54 of the bolt-hold lock 24 holds the bolt-hold lock 24 in the extended position while the empty magazine 6 is removed and a new magazine 6 is inserted. The magazine follower 7 of the new, non-empty, magazine 6 is not being pushed up far enough by the magazine spring 4 as to push on the follower contact ledge 23 and therefore, the bolt-hold lock 24 is no longer biased by the force of the magazine spring 4 but is held in place by pressure and friction from the face of the spring-loaded bolt 14 against the bolt catch edge 54. A pin 27 pivotally holds the bolt release lever 40 to the frame 22. While the bolt-hold lock 24 moves up, the bolt-hold lock pin 25 affixed to a distal area 52 of the bolt-hold lock 24 pushes upwardly on the bolt release lever 40, rotating the bolt release lever 40 around pin 27 and pushing the bolt-hold release paddle 44 in an opposing downward direction with respect to the magazine frame 22. The bolt-hold release paddle 44 is affixed to the bolt-hold release lever 40 by, for example, pins 46/48 or any other fastening arrangement. After the new magazine 6 is inserted, the bolt-hold release paddle 44 is pushed upward by the shooter, pulling the bolt-hold lock pin 25 downward and, hence, pulling the bolt-hold lock 24 downward (retracted position) until the bolt catch edge 54 clears the face of the spring-loaded bolt 14 and the spring-loaded bolt 14 moves forward, catching the top round 8 from the new magazine 6 and pushing the top round 8 into the chamber 15, ready to fire. A bolt-hold lock return spring 38 keeps the bolt-hold lock 24 biased in the retracted (down with respect to FIG. 4) position so as to prevent the bolt-hold lock 24 from sliding upwardly when there are still rounds 8 in the magazine 6.

While there are rounds 8 remaining in the magazine 6, the bolt-hold lock 24 is biased away from the bolt 14 by the bolt-hold lock return spring 38 and as the bolt 14 is forced away from the chamber 15.

After firing of a round 8, a first distinctive noise is made, full recoil is felt and the bolt carrier charge handle is visibly forward in the lock-up position. After firing of the last round 8 from the magazine 6 (e.g., the magazine 6 is empty), as the bolt 14 is forced away from the chamber 15, the angled leading edge 13 of the bolt 14 hits the angled forward edge 23 of the bolt-hold lock 24, making a different, second, distinctive noise, partial recoil is felt, and the bolt carrier charge handle is visibly rearward out of lock-up. The shooter will know when the last round 8 has been fired based upon these differences and can eject the empty magazine 6, replace the empty magazine 6 with a new magazine 6 and press the bolt-hold release paddle 44 to chamber a first round 8 from the new magazine 6 without having to re-cock the bolt 14.

On the opposing side of the frame 22 is a magazine release button 30. The magazine release button 30 is outwardly spring biased by a magazine catch spring 36 and interfaces to a magazine catch 42 by a magazine catch adjustment spacer 34 with a fastener 32 (e.g. screw 32). After the shooter realizes that the last round 8 has been fired, the shooter presses the magazine release button 30 and the magazine catch 42 moves outwardly, thereby releasing the empty magazine 6 which drops out of the magazine frame 22.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A firearm-magazine interface for a firearm having a spring-loaded bolt and a receiver cross-member pin, the receiver cross-member pin located in the vicinity of a magazine opening of the firearm, the firearm-magazine interface comprising:

a magazine frame for receiving a magazine, the magazine frame mountable to the firearm at the magazine opening;

a bolt-hold lock, the bolt-hold lock slideably interfaced to the magazine frame, a follower contact ledge of the bolt-hold lock interfaceable with a magazine follower of the magazine, the bolt-hold lock has a retracted position in which a spring-loaded bolt of the firearm freely passes by the bolt-hold lock and the bolt-hold lock has an extended position, such that when the magazine is empty, the magazine follower pushes on the follower contact ledge and the follower contact ledge lifts the bold-hold lock into the extended position, thereby a bolt catch edge of the bold-hold lock is positioned to engage with a face of the spring-loaded bolt to hold the spring-loaded bolt in an open position after a last round is fired from the magazine;

a bolt release lever is moveably interfaced to the magazine frame; and a bolt-hold release paddle affixed to the bolt release lever, whereas activation of the bolt-hold release paddle rotates the bolt release lever and urges the bolt-hold lock from the extended position to the retracted position, away from the face of the spring-loaded bolt, thereby adapted to release the spring-loaded bolt;

whereas the bolt-hold lock is adapted to brace against the receiver cross-member pin of the firearm, providing support to counter a force exerted by the spring-loaded bolt.

2. The firearm-magazine interface of claim 1, further comprising a spring-loaded magazine release button, the spring-loaded magazine release button moveably interfaced to the magazine frame on a side of the magazine frame distal from the bolt-hold release paddle.

3. The firearm-magazine interface of claim 2, wherein the spring-loaded magazine release button is coupled to a magazine catch by an adjustable spacer for adjusting a depth of the release button and a pressure required to eject the magazine.

4. The firearm-magazine interface of claim 2, wherein the magazine catch is on a same side of the magazine frame as the bolt-hold release paddle.

5. The firearm-magazine interface of claim 1, wherein the bolt-hold lock has an angled forward edge closest to the chamber and a bolt catch edge distal from the chamber and wherein the angled forward edge is formed at an angle such that when the bolt-hold lock is in the extended position, the bolt-hold lock is configured to be temporarily pushed downwardly into the retracted position by an angled leading edge of the spring-loaded bolt pushing against the angled forward edge of the bolt-hold lock, thereby allowing the spring-loaded bolt to travel past the bolt-hold lock after firing of a last round.

6. The firearm-magazine interface of claim 5, wherein the bolt catch edge of the bolt-hold lock is substantially parallel to a face of the spring-loaded bolt, thereby the bolt catch edge is adapted to hold the spring-loaded bolt open after firing of a last round from the magazine.

7. The firearm-magazine interface of claim 1, wherein the firearm is an AK variant of firearms and the magazine is an AR15 magazine.

8. A firearm-magazine interface for a firearm having a bolt for chambering rounds of ammunition, a chamber and a receiver cross-member pin, the receiver cross-member pin located in the vicinity of a magazine opening of the firearm, the firearm-magazine interface comprising:

a magazine frame for receiving a magazine, the magazine frame adapted to be fastened to the firearm at the magazine opening;

a bolt-hold lock, the bolt-hold lock is slideably interfaced to and held by the magazine frame, the bolt-hold lock is configured to brace against the receiver cross-member pin, providing support to counter a force exerted by the bolt, a first area of the bolt-hold lock has an angled forward edge on a side of the bolt-hold lock closest to the chamber of the firearm, the first area of the bolt-hold lock has an opposing substantially flat bolt catch edge on a side of the bolt-hold lock distal from the chamber, the bolt-catch edge being substantially perpendicular to a path of travel of the bolt, the first area of the bolt-hold lock also having a follower contact ledge, a distal second area of the bolt-hold lock having a bolt-hold lock pin;

the follower contact ledge of the bolt-hold lock is interfaceable with a magazine follower of the magazine;

a bolt release lever is rotatably interfaced to the magazine frame and the a first end of the bolt release lever interfaces to the bolt-hold lock pin;

a bolt-hold lock return spring urges the bolt release lever such that the bolt-hold lock is biased away from the path of travel of the bolt; and a bolt-hold release paddle, the bolt-hold release paddle is affixed to a second end of the bolt release lever;

whereas after a last round of the magazine is chambered, the follower contact ledge is adapted to be pushed by the magazine follower of the magazine and thereby urges the bolt-hold lock into the path of travel of the bolt and after firing of the last round, the angled forward edge of the bolt-hold lock is adapted to be pushed by a leading edge surface of the bolt to momentarily displace the bolt-hold lock out of the path of travel of the bolt and after the bolt passes the bolt-hold lock, the bolt-hold lock is adapted to return into the path of travel of the bolt such that, the bolt is held open by the bolt catch edge of the bolt-hold lock;

whereas pressing of the bolt-hold release paddle after the bolt is held open by the bolt-hold lock urges the bolt-hold lock away from the bolt, thereby releasing the bolt towards the chamber.

9. The firearm-magazine interface of claim 8, further comprising a spring-loaded magazine release button, the spring-loaded magazine release button slideably interfaced to the magazine frame on a side of the magazine frame distal to the bolt-hold release paddle.

10. The firearm-magazine interface of claim 9, wherein the spring-loaded magazine release button is coupled to a magazine catch by an adjustment spacer, the magazine catch is adapted to removably hold the magazine in the magazine frame.

11. The firearm-magazine interface of claim 9, wherein the magazine catch is on a same side of the magazine frame as the bolt-hold release paddle.

12. The firearm-magazine interface of claim 8, wherein a sound made by the firearm after a last round is fired and the magazine is empty of rounds is different than a sound made by the firearm after a non-last round is fired and the magazine has remaining rounds.

13. The firearm-magazine interface of claim 8, wherein a recoil motion of the firearm after a last round is fired and the magazine is empty of rounds is different than a recoil motion of the firearm after a non-last round is fired and the magazine has remaining rounds.

14. The firearm-magazine interface of claim 8, wherein a visual rearward position of a carrier charge handle interfaced to the bolt of the firearm after a last round is fired and empty of rounds is different than a visual forward lock-up position of the carrier charge handle after a non-last round is fired and the magazine has remaining rounds.

15. The firearm-magazine interface of claim 8, wherein the firearm is an AK variant of firearms and the magazine is an AR15 magazine.

16. A firearm-magazine interface for a firearm having a bolt for chambering rounds of ammunition, a chamber and a receiver cross-member pin, the receiver cross-member pin located in the vicinity of a magazine opening of the firearm, the firearm-magazine interface comprising:

a magazine frame for receiving a magazine, the magazine frame fastenable to the firearm at the magazine opening;

a bolt-hold lock, the bolt-hold lock is slideably interfaced to and held by the magazine frame, the bolt-hold lock is configured to brace against the receiver cross-member pin, providing support to counter a force exerted by the bolt, a first area of the bolt-hold lock has an angled forward edge on a side of the bolt-hold lock that is closest to the chamber of the firearm, the first area of the bolt-hold lock has a substantially flat bolt-catch edge on a side of the bolt-hold lock that is distal from the chamber, the bolt-catch edge is substantially perpendicular to a path of travel of the bolt, the bolt-hold lock has a follower contact ledge that interfaces with a magazine follower of the magazine, a distal second area of the bolt-hold lock has a bolt-hold lock pin;

a release lever is pivotally interfaced to the magazine frame, a first end of the release lever interfaces to the bolt-hold lock pin and a second, distal end of the release lever interfaces to a bolt-hold release paddle, the bolt-hold release paddle is movably mounted on a first side of the magazine frame;

a bolt-hold lock return spring is interfaced between the magazine frame and the release lever, the bolt-hold lock return spring urges the release lever in a direction that biases the bolt-hold lock away from the path of travel of the bolt; and a magazine release button is movably affixed to a second opposing side of the magazine frame, the magazine release button is urged outwardly from the magazine frame by a magazine catch spring, the magazine release button is mechanically interfaced to a magazine catch;

whereas after a last round of the magazine is chambered, the magazine follower of the magazine urges the bolt-hold lock into the path of travel of the bolt and after firing of the last round, an angled leading surface pushes against the angled forward edge of the bolt, momentarily displacing the bolt-hold lock out of the path of travel of the bolt, and after the bolt passes the bolt-hold lock, the bolt-hold lock returns into the path of travel of the bolt and the face of the bolt pushes against the bolt catch edge of the bolt-hold lock and the bolt is held open by the bolt-hold lock;

whereas pressing of the bolt-hold release paddle after the bolt is held open by the bolt-hold lock urges the bolt-hold lock away from the bolt, thereby releasing the bolt towards the chamber;

whereas pressing of the magazine release button moves the magazine catch outwardly away from the magazine frame for releasing the magazine from the magazine frame.

17. The firearm-magazine interface of claim 16, wherein the magazine release button is coupled to the magazine catch by an adjustment spacer.

18. The firearm-magazine interface of claim 16, wherein a sound made by the firearm after a last round is fired and the magazine is empty of rounds is different than a sound made by the firearm after a non-last round is fired and the magazine has remaining rounds.

19. The firearm-magazine interface of claim 16, wherein a recoil motion of the firearm after a last round is fired and the magazine is empty of rounds is different than a recoil motion of the firearm after a non-last round is fired and the magazine has remaining rounds.

20. The firearm-magazine interface of claim 16, wherein a visual rearward position of a carrier charge handle interfaced to the bolt of the firearm after a last round is fired and empty of rounds is different than a visual forward lock-up position of the carrier charge handle after a non-last round is fired and the magazine has remaining rounds.

* * * * *